US006523942B2

(12) United States Patent
Sakamoto et al.

(10) Patent No.: US 6,523,942 B2
(45) **Date of Patent: *Feb. 25, 2003**

(54) INKJET HEAD HAVING PLURAL INK SUPPLY CHANNELS BETWEEN INK CHAMBERS AND EACH PRESSURE CHAMBER

(75) Inventors: Yoshiaki Sakamoto, Kawasaki (JP); Shuji Koike, Kawasaki (JP); Tomohisa Mikami, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/444,391

(22) Filed: Nov. 22, 1999

(65) Prior Publication Data

US 2002/0109756 A1 Aug. 15, 2002

(30) Foreign Application Priority Data

Nov. 26, 1998 (JP) ..... 10-335929

(51) Int. Cl.[7] ..... B41S 2/045
(52) U.S. Cl. ..... 347/68; 347/70

(58) Field of Search ..... 347/68, 70, 71, 347/72, 65

(56) References Cited

U.S. PATENT DOCUMENTS 5,896,149 A * 4/1999 Kitahara et al. ..... 347/65 X
5,940,099 A * 8/1999 Karlinski

FOREIGN PATENT DOCUMENTS

JP 07156382 A 6/1995
JP 09295403 A 11/1997

* cited by examiner

*Primary Examiner*—William Oen
*Assistant Examiner*—Charlene Dickens
(74) *Attorney, Agent, or Firm*—Armstrong, Westerman & Hattori, LLP

(57) ABSTRACT

It is an object of the present invention to provide an inkjet head and its manufacturing method, which may realize a high resolution while maintaining at a desired strength those walls which define a plurality of ink supply channels between the common ink chamber and each pressure chamber, and securing the adhesion areas on these walls. The inkjet head is miniaturized in a direction in which the pressure chambers are arranged, by arranging a plurality of ink supply channels that are connected to each pressure chamber perpendicular to the direction in which the pressure chambers are arranged.

6 Claims, 15 Drawing Sheets

INKJET HEAD HAVING PLURAL INK SUPPLY CHANNELS BETWEEN INK CHAMBERS AND EACH PRESSURE CHAMBER

BACKGROUND OF THE INVENTION

The present invention generally relates to print heads for printers, and more particularly to a head (or an inkjet head) for use with an inkjet printer. The inkjet head of the present invention is applicable not only to a single printer unit but also widely to copiers, facsimile machines, computer systems word processors, and combination machines thereof which have a printing function.

Among inkjet heads, those which employ a piezoelectric element have increasingly come into the limelight in recent years due to their excellence in energy efficiency. This type of inkjet head typically includes a piezoelectric element, one common ink chamber which receives from an external device and stores ink, a plurality of pressure chambers coupled to the piezoelectric element, and a nozzle plate so connected to the pressure chambers that a nozzle may be connected to each pressure chamber. Each pressure chamber is connected to the common ink chamber through an ink supply channel so that it may receive ink from the common ink chamber and increase its internal pressure using deformation of the piezoelectric elements, thereby jetting ink from each nozzle.

In recent years, piezoelectric elements have often been manufactured by printing or sputtering of LSI technology. The LSI technology facilitates miniature piezoelectric elements, while the miniature ink supply channels are needed as well. A higher resolution is also needed by reducing an interval between two nozzles of adjacent pressure chambers (i.e., nozzle pitch) and increasing the number of nozzles. The miniature ink supply channels are also required for this purpose. The miniature ink supply channels are thus sought for both manufacturing and higher-resolution purposes.

According to ink's hydraulic resistance equivalence, a doubled number of ink supply channels would make the length of the ink supply channel twice as long as that of one ink supply channel. A quadrupled number of ink supply channels would make the length of the ink supply channel four times as long as that of one ink supply channel. Thus, in terms of hydrodynamics, ink's hydraulic resistance equivalence is maintained by increasing the length of the ink supply channel by the number of ink supply channels.

On the other hand, an ink supply channel has been demanded which is longer than a distance between adjacent pressure chambers since a long ink supply channel would enhance rigidity and strength of a wall between the common ink chamber and each pressure chamber. Some head configurations are required to be a adhered to a thin film before being adhered to a piezoelectric element in a pressure-chamber plate that includes pressure chambers, ink supply channels and a common ink chamber. Such a head calls for a longer ink supply channel so that the thin film can be firmly adhered to a larger area between each pressure chamber and the common ink chamber.

For these requirements, each pressure chamber has been allocated a plurality of (e.g., four) ink supply channels that align with a direction in which the pressure chambers are arranged in a conventional inkjet head.

However, the instant inventors have discovered those ink supply channels, which align with a direction in which the pressure chambers are arranged as in the conventional inkjet head, would prevent a higher resolution. This is because a nozzle pitch that is designed to be narrow so as to attain a high integration would necessarily lead to the narrow pressure chamber width, and it would be extremely difficult to establish multiple ink supply channels in the narrow width.

BRIEF SUMMARY OF THE INVENTION

Accordingly, it is an exemplified general object of the present invention to provide a novel and useful inkjet head and its manufacturing method in which the above disadvantages are eliminated.

A more specific object of the present invention is to provide an inkjet head and its manufacturing method which may realize a high resolution, maintain at a desired strength a wall that defines an ink supply channel between a common ink chamber and each pressure chamber, and secures a sufficient adhesion area on the wall.

The present invention also has an object to provide an inkjet head and its manufacturing method which allocate a plurality of ink supply channels so as to connect each pressure chamber to the common ink chamber, and use a dry film resist for high-precision and efficient manufacturing.

To achieve the above objects, an inkjet head of the present invention comprises a pressure-chamber plate which includes a plurality of pressure chambers which store ink and a plurality of ink supply channels that supply the pressure chamber with the ink, a piezoelectric element that may pressurize the pressure chamber in the pressure-chamber plate, and a nozzle plate that includes a nozzle which jets the ink in the pressure chamber when the piezoelectric element pressurizes the pressure chamber, wherein some of the ink supply channels are connected by the plural number to each pressure chamber, and arranged in a direction perpendicular to that in which the plurality of pressure chambers are arranged. Alternatively, said ink supply channels may be connected by the plural number to each pressure chamber, and arranged two-dimensionally at random with respect to a plane parallel to a direction in which the plurality of pressure chambers are arranged.

A manufacturing method for an inkjet head which is manufactured by joining a plurality of layered members that is made of independent multiple layers, including the step of forming one of the plurality of layered members which comprises the steps of forming a layered member by laminating a dry film resist onto a substrate having a predetermined shape, exposing part of the layered member which corresponds to pressure chambers, an ink supply channel, and a common ink chamber, and developing the layered member, wherein a plurality of ink supply channels are formed and connecting each of a plurality of pressure chambers to the common ink chamber, a direction in which the plurality of pressure chambers are arranged being perpendicular to that in which the ink supply channels allocated to each of the plurality of pressure chambers are arranged.

A manufacturing method of an inkjet head of the present invention comprises the steps of forming first and second layers defining at least one of an introduction path, a pressure chamber, an ink supply channel and a common ink chamber by using a dry film resist, forming a rigid layer on either one of the first and second layers, and joining the first and second layers to each other via the rigid layer.

A printer of the present invention comprises an inkjet head, and a drive unit which drives the inkjet head, wherein the inkjet head comprises a pressure-chamber plate that includes a plurality of pressure chambers which store ink and a plurality of ink supply channels which supply the pressure chambers with the ink, a piezoelectric element that may pressurize the pressure chamber in the pressure-chamber plate, and a nozzle plate that includes a nozzle which jets the ink in the pressure chambers when the piezoelectric element pressurizes the pressure chamber, wherein part of the ink supply channels are connected to each pressure chamber, and arranged in a direction perpendicular to that in which the plural pressure chambers are arranged.

A printer and an inkjet head of the present invention include a plurality of ink supply channels that are connected to each pressure chamber and arranged in a direction perpendicular to a direction in which the pressure chambers are arranged. Therefore, where the predetermined number of ink supply channels is needed, all of them need not align with a direction in which the pressure chambers are arranged. This however intends to exclude a structure in which all of the ink supply channels align with a direction with which the pressure chambers align, and not to prohibit some of the ink supply channels from aligning with the direction with which the pressure chambers align. For example, given three ink supply channels, two of them may align with a direction with which the pressure chambers align. Alternatively, the ink supply channels may be arranged two-dimensionally at random, independently of the direction in which the pressure chambers are arranged. Hereupon, the clause "arranged two-dimensionally at random" intends to exclude a structure in which all of the ink supply channels align only with a direction with which the pressure chambers align, as described in more detail in the following embodiments.

The number of ink supply channels that are allocated to each pressure chamber of the present invention is determined as follows. Firstly, a size of one ink supply channel that may maintain a proper balance with ink's hydraulic resistance as described in the following embodiment with reference to FIG. 6 is determined in terms of the depth, length and width of the ink supply channel. Where a dry film resist is used to create an ink supply channel, the thickness of the dry film resist becomes the depth of the ink supply channel. Thus, from among some dry film resist candidates having different thickness, those dry film resists having the depth with little fluctuation in terms of the depth, length and width of the ink supply channel are selected. This determines the thickness of a dry film and consequently the size of the ink supply channel. The ink supply channel determined here, however, becomes shorter than an interval (i.e., wall thickness) between the adjacent pressure chambers, and would deteriorate the strength and adhesion with another component of the wall that defines the ink supply channels. The present invention accordingly intends to keep ink's hydraulic resistance equivalent by setting the ink supply channel to be at least equal to, or preferably longer than, the wall between the pressure chambers, while setting the number of ink supply channels to be a quotient produced by dividing the wall thickness between the pressure chambers by the original length of the ink supply channel.

A member with a high Young's modulus, if provided between two adjacent ink supply channels connected to each pressure chamber, would prevent these ink supply channels from negatively influencing each other, keeping them stable.

The manufacturing method of an inkjet head of the present invention allows the ink supply channels made of a dry film resist to align with a direction different than that with which the pressure chambers align. A metal or ceramic layer, if provided between two dry film resists that form an ink supply channel, would keep adjacent ink supply channels stable even after they are joined. A resin or composite resin member, if used in place of metal or ceramic, has a thermal expansion coefficient close to that of a dry film resist, and would provide an inkjet head with thermally homogeneous components.

The manufacturing method for an inkjet head of the present invention that provides a layer comprising such a rigid member as metal or ceramic between the adjacent layers defining ink supply channels, may be widely applied in general as a manufacturing method for an inkjet head using dry film resists.

Other objects and further features of the present invention will become readily apparent from the following description of the embodiments with reference to accompanying drawings.

DETAILED DESCRIPTION OF THE INVENTION

Figure 1:
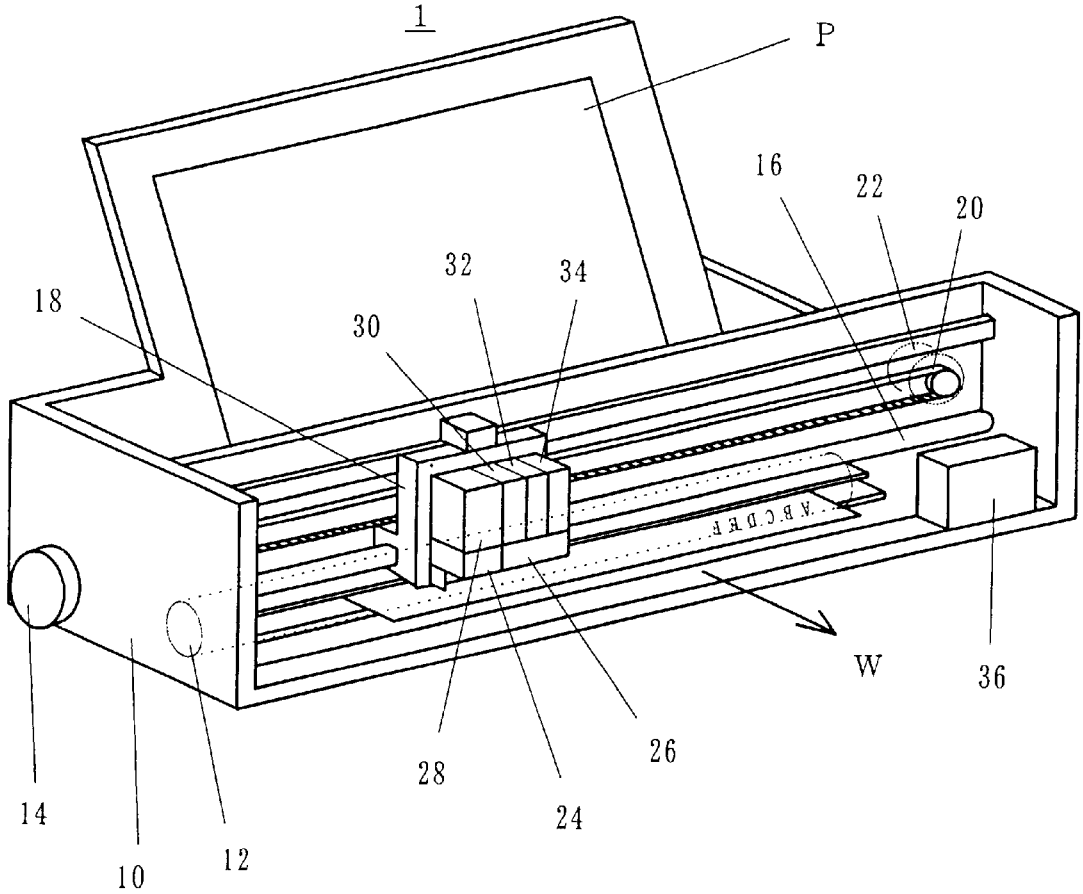
FIG. 1 is a schematic perspective view of an inkjet printer to which an inkjet head of the present invention is applicable.

A description will now be given of inkjet head 100, its manufacturing method, and inkjet printer 1 having the head 100 of the present invention and its manufacturing method, with reference to the accompanying drawings. Those elements in each drawing that are designated by the same reference numerals denote the same elements. and a duplicate description will be omitted. Those elements, which are designated by the same reference number and an alphabetical letter, indicate that they are the same types of components, but are differentiated by the alphabet character and are grouped by simple reference numbers.

FIG. 1 schematically shows an embodiment of color ink et printer (recording device) 1 which may employ the inkjet head 100 of the present invention that is described later in detail. Housing 10 of the recording device 1 pivotally includes platen 12.

In recording operation, the platen 12 is driven and intermittently rotated by drive motor 14, whereby printing paper P is fed intermittently at a predetermined pitch in arrow direction W. The housing 10 of the recording device 1 also includes guide rod 16 parallel to and above the platen 12, and carriage 18 is slidably attached to this guide rod 16.

The carriage 18 is attached to free-end drive belt 20 that is driven by drive motor 22, whereby the carriage 18 is reciprocated (scanned) along the platen 12.

The carriage 18 is mounted with recording head 24 for black color and recording head 26 for multiple colors. The recording head 26 for multiple colors may be comprised of three parts. The recording head 24 for black color is detachably mounted with black ink tank 28, while the recording head 26 for multiple colors is detachably mounted with color ink tanks 30, 32, and 34. The inkjet head 100 of the present invention is applied to these recording heads 24 and 26 as described later.

The black ink tank 28 stores black ink, whereas the color ink tanks 30, 32 and 34 respectively store yellow ink, cyan ink and magenta ink.

While the carriage 18 reciprocates along the platen 12, the recording head 24 for black color and the recording heads 26 for multiple colors are driven based upon image data obtained from a word-processor, a personal computer, etc., thereby recording given characters, images, etc. on the printing paper P. When the recording operation ends, the carriage 18 returns to a home position, where a nozzle maintenance mechanism (backup unit) 36 is provided.

The nozzle maintenance mechanism 36 includes a movable suction cap (not shown) and a suction pump (not shown) connected to this movable suction cap. When the recording heads 24 and 26 are positioned at the home position, the suction cap becomes adhered to the nozzle plate in each recording head, and nozzles on the nozzle plate are suctioned by driving the suction pump, thus preventing any nozzle clogs.

Figure 2:
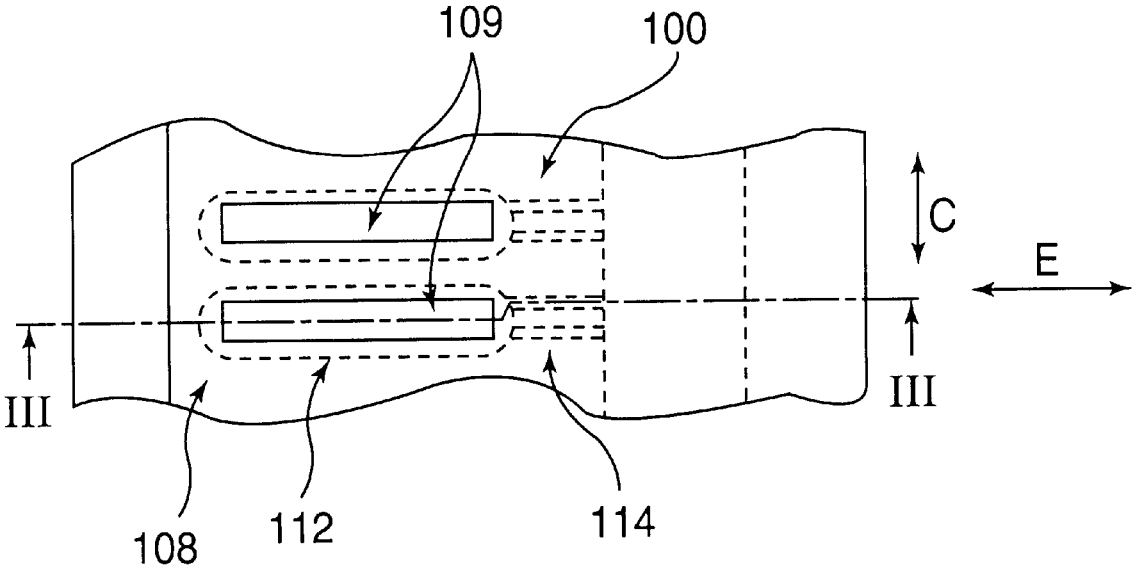
FIG. 2 is a partial plan view of an inkjet head of a first embodiment according to the present invention.
Figure 3:
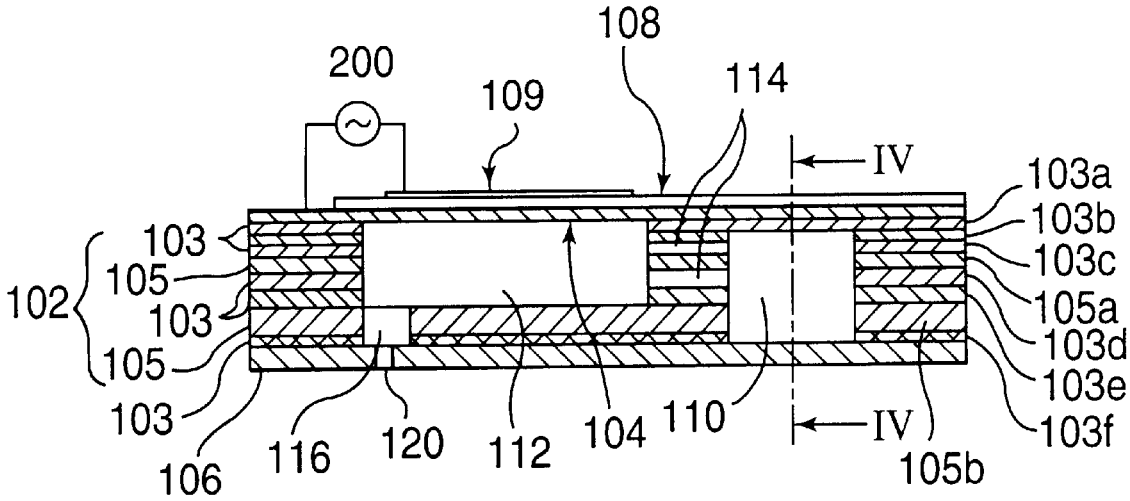
FIG. 3 is a cross section taken along line A–A' in FIG. 2.
Figure 4:
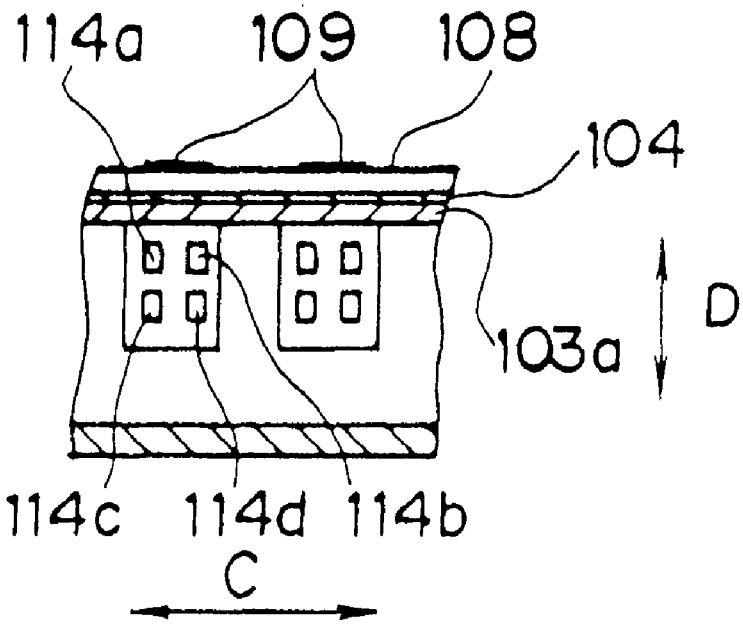
FIG. 4 is a cross section taken along line B–B' in FIG. 3.

Next, a description will be given of the inkjet head 100 of the present invention by referencing FIGs. 2 through 4. Hereupon, FIG. 2 is a partial plan view of the inkjet head 100 of the present invention. FIG. 3 is a cross-sectional view taken along line A–A' in FIG. 2. FIG. 4 is a cross-section view taken along line B–B' in FIG. 3.

The inkjet head 100 of the present invention includes pressure-chamber plate 102, oscillatory plate 104, nozzle plate 106 and piezoelectric element 108.

As described later in detail, the pressure chamber plate 102 includes a layered member in which a plurality of dry film resists 103 are laminated onto stainless plate 105, and forms common ink chamber 110, a desired number of pressure chambers 112, a plurality of ink supply channels 114 and introduction path 116 by a photo-lithography manufacturing method. For more details, layers 1–3, 5, 6 and 8 from the top are each the dry film resist 103, and layers 4 and 7 from the top are stainless plate 105 in FIG. 3. A patterning process which uses a dry film resist facilitates a 0.1–1 μm precision mass manufacture by the photo-lithography manufacturing method, and thus it is useful as a component for an inklet head that requires high precision and low cost.

Optionally, the present invention may make the pressure-chamber plate 102 of an approximately cuboid glass plate, but it exhibits an additional effect if using a dry film resist, as described later.

The common ink chamber 110 supplies ink to each pressure chamber 112 through the ink supply channels 114. The common ink chamber 110 has such an adjusted ink hydraulic resistance as would absorb a sudden fluctuation in the internal pressure of the pressure chamber 112, and is connected to an external ink supply device (not shown). The common ink chamber 110 supplies a necessary amount of ink to the pressure chamber 112, when the pressure chamber 112 recovers the position after discharging ink as a result of compression and contraction. Such an ink supply is controllable by the ink hydraulic resistance.

The pressure chamber 112 is formed as an approximately cuboid space by cutouts in each layer in the pressure-chamber plate 102 and the elastically deformable oscillatory plate 104. A plurality of pressure chambers 112 align in direction C in FIGS. 2 and 4. The pressure chamber 112 receives and stores ink, and jets it from the nozzle 120 via the introduction path 116 as the internal pressure increases. As described later, the internal pressure changes as the piezoelectric element 108 deforms. In addition, as described later, the introduction path 116 is not an indispensable element of the pressure-chamber plate 102.

A design of the inkjet head 100 requires the determination of a size of ink supply channel 114. The ink supply channel 114 is so dimensioned that the pressure chamber 112 may jet an adequate amount of ink from the nozzle 120. When the pressure chamber 112 jets ink from the nozzle 120, ink also regurgitates to the ink supply channels 114. Nevertheless, the proper balance in ink hydraulic resistance between a channel from the pressure chamber 112 to the nozzle 120 and that from the pressure chamber 112 to the ink supply channel 114 would enable ink to be jetted mainly from the nozzle 120.

A description will be given below of how to determine the size (depth Ds, length Ls and width Ws) of ink supply channel 114 having the proper ink hydraulic resistance. The inkjet head 100 of this embodiment sets the nozzle 120 to be 20 μm in diameter and 20 μm in length, the introduction path 116 85 μm across and 70 μm long, and the pressure chamber 112 1700 μm across, 100 μm wide and 130 μm deep.

Figure 6:
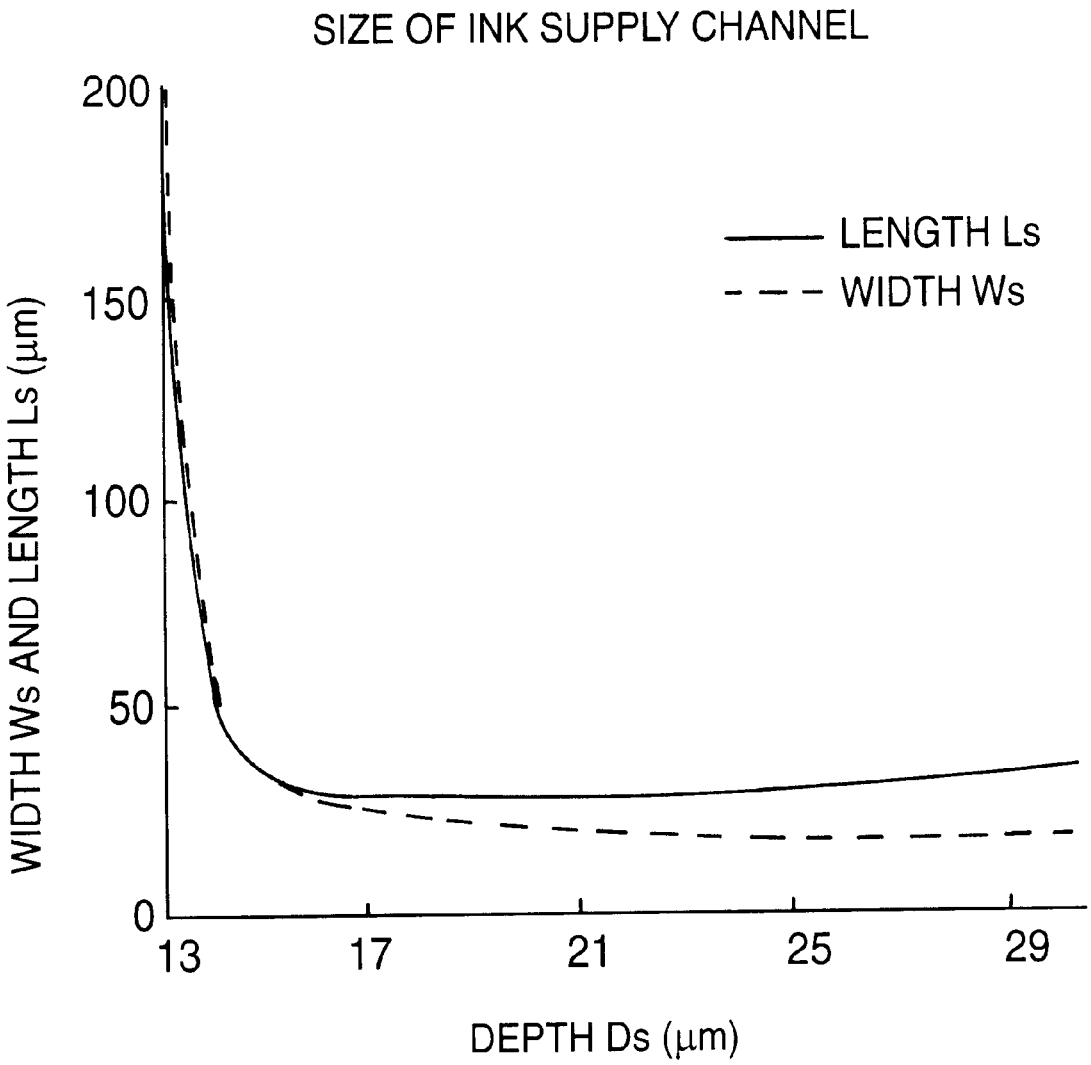
FIG. 6 is a graph that shows the relationship among the depth, length and width required for one ink supply channel in order to realize the desired ink hydraulic resistance.

Table 1 below shows how the matching length Ls and width Ws of the ink supply channel 114 change accordingly when its depth Ds changes in increments of 1 μm from 13 to 30 μm. FIG. 6 shows a relationship between Ds and Ls, and that between Ds and Ws.

| Size of Ink Supply Channel 114 (μm) | | |
|---|---|---|
| Depth Ds | Length Ls | Width Ws |
| 13 | 172.2 | 190.9 |
| 14 | 49.6 | 51.0 |

-continued

| Size of Ink Supply Channel 114 (μm) | | |
|---|---|---|
| Depth Ds | Length Ls | Width Ws |
| 15 | 34.5 | 33.1 |
| 16 | 29.7 | 26.7 |
| 17 | 27.7 | 23.5 |
| 18 | 26.9 | 21.6 |
| 19 | 26.7 | 20.2 |
| 20 | 26.7 | 19.2 |
| 21 | 26.8 | 18.4 |
| 22 | 27.1 | 17.7 |
| 23 | 27.5 | 17.2 |
| 24 | 28.0 | 16.8 |
| 25 | 28.6 | 16.5 |
| 26 | 29.2 | 16.2 |
| 27 | 29.9 | 15.9 |
| 28 | 30.6 | 15.7 |
| 29 | 31.3 | 15.5 |
| 30 | 32.0 | 15.4 |

In an attempt to form the ink supply channel 114 by a patterning process using a dry film resist, the depth Ds of the ink supply channel 114 is determined by the thickness of the dry film resist. This embodiment prepares 14 μm, 24 μm and 29 μm as the thickness of the dry film resist. Referring to these values in FIG. 6, it is understood that Ds fluctuation would greatly change, where Ds−14 μm, required values of both Ls and Ws and would provide the manufacturing with only a small margin for patterning size. In contrast, Ds fluctuation would not greatly change, where Ds−24 μm or 29 μm, required values of both Ls and Ws, providing a mitigated patterning size precision for the photo-lithography manufacturing method. Accordingly, this embodiment has selected Ds−29 μm that would cause less fluctuation. Empirically, the Ds fluctuation would result in a decrease by −1 μm or so in the joining process that will be described later.

FIG. 6 shows that one ink supply channel having a size of Ls=31.3 μm and Ws=15.5 μm may be formed where Ds=29 μm is selected. According to FIG. 3, the length Ls of an ink supply channel is also the length of a wall between each pressure chamber 112 and the common ink chamber 110, and this wall requires a certain degree of rigidity and strength (at least longer than an interval between the adjacent pressure chambers 112). This wall also requires a sufficient adhesion area for firm adhesion with upper and lower layers. Ink's hydraulic resistance of the ink supply channel 114 is equivalently maintained as far as its length Ls is in proportion to the number of the channels. Accordingly, this embodiment has used four ink supply channels each of which has a size of Ls=125 μm, which is calculated by Ls=31.3 μm x 4≈125 μm, Ds=29 μm and Ws=15.5 μm.

These four ink supply channels 114 are connected to each pressure chamber 112, but arranged, as best shown in FIG. 4, in a 2×2 matrix in direction C and direction D perpendicular to the direction C.

Figure 5:
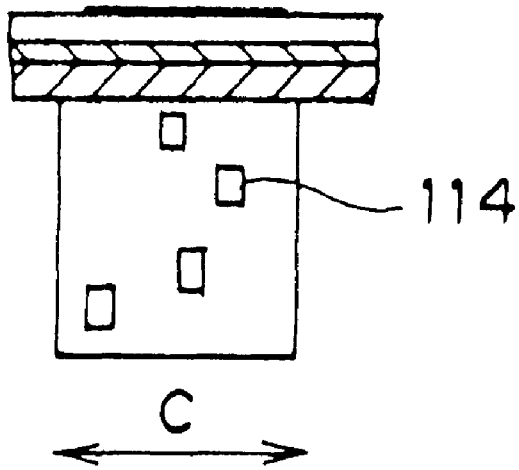
FIG. 5 is an exemplified variation of the arrangement of ink supply channels shown in FIG. 4.

According to this embodiment, as shown in FIG. 4 and FIG. 5 which will be described later, where four ink supply channels 114 are referred to as 114*a* to 114*d*, the Young's modulus for a layer (stainless layer 105*a* in FIG. 3) which partitions 114*a* and 114*c* as well as 114*b* and 114*d* is higher than the Young's modulus of the dry film resist layer 103*c* forming 114*a* and 114*b*, and higher than the Young's modulus of the dry film resist layer 103*d* forming 114*c* and 114*d*. The stainless layer 105*a* may use another rigid metal or ceramic material.

The layer 105*a* having such a high Young's modulus, which will be described by referring to FIG. 7 later, allows the ink supply channels 114 to be formed in the layers 103*c* and 103*d* with high precision using a dry film resist.

As a typical conventional inkjet head arranges and levels with one another all the ink supply channels 114 in direction C, this arrangement prevents the pressure chamber 112 to be narrowed in the direction C, limiting the realization of high resolution. The width of each pressure chamber 112 in this embodiment is 100 μm. If four ink supply channels 114 having width Ws=15.5 μm are formed on the same dry film resist layer as the pressure chamber 112, the remaining width in the dry film resist would be about 13 μm, thus making the patterning difficult.

Accordingly, a 5 pl ink drop jet has been realized by dividing and laminating four ink supply channels into two each in the direction of the depth (direction D) of the pressure chamber, as shown in FIG. 4. The pitch between the adjacent pressure chambers (nozzles) has been then 1/150 inches (=169 μm). Four rows of nozzles 120 could realize the resolution of about 600 dpi. When the pressure chamber width is further narrowed in accordance with the settings of the characteristics of a drive element and an ink jet, the ink supply channel 114 may be likewise designed.

Although the present invention thus arranges some of the ink supply channels 114 in the direction C and the remaining in the direction D perpendicular to C direction, it may be easily understood that any number from 1 to 3 may be selected for arrangement in the direction C. For example, three ink supply channels arranged in the C direction and one in the D direction would realize higher resolution than the conventional configuration, and thus this variation is also within the scope of the present invention. The arrangement of one in the C direction and the remaining three in the D direction will be described later.

"A direction perpendicular to the direction (the direction C) in which the piezoelectric elements are arranged" in this application apparently includes not only the direction D but direction E, as the embodiment will be described later. The ink supply channels 114 need not form a complete matrix. For example, the present invention covers such a structure as would arrange the ink supply channels 114 two-dimensionally at random as shown in FIG. 5, when the inkjet head 100 is sectioned on a plane parallel to the direction in which the piezoelectric elements 108 are arranged. Those structures which arrange "the ink supply channels two-dimensionally at random" cover all the structures except the one that arranges the ink supply channels 114 only in the direction in which the piezoelectric elements 108 are arranged.

The locations of the introduction path 116 and nozzle 120 are not limited to those shown in FIG. 3. For example, a nozzle plate including nozzles may be in the left end in FIG. 2 so as to jet ink parallel to the direction E, while the introduction path 116 is omitted.

The oscillatory plate 104 and piezoelectric element 108, which are composed as a bimorph layered member, form one surface of each pressure chamber 112. The piezoelectric element 108 is connected to the drive circuit 200, and the drive circuit 200 supplies a drive signal to separate electrode 109 as an external electrode of the piezoelectric element 108. This embodiment does not divide the piezoelectric elements 108 for each pressure chamber 112, and the oscillatory plate 104 and piezoelectric elements 108 extend over multiple pressure chambers 112.

The oscillatory plate 104 preferably comprises an elastically deformable metal thin film that has a certain degree of rigidity, like a chromium and nickel film, and serves to transmit a deformation of the piezoelectric element 108 to the pressure chamber 112. The thickness of the oscillatory plate 104 is about 2 $\mu$m, for example.

The piezoelectric element 108 in this embodiment has been grown as a single layer by sputtering, but may include a layered structure. Unlike this embodiment where the oscillatory plate 104 and piezoelectric elements 108 are laminated all over MgO substrate 122 as described later, the piezoelectric elements 108 may be formed only within a limited predetermined area. The piezoelectric element 108 as a single layer does not include an internal electrode, and is connected to a signal electrode as an external electrode. An internal electrode is provided in each layer, and connected to the foregoing external electrode in the stacked layers. The piezoelectric element 108 can employ any structure known in the art, and a detailed description thereof will be omitted. Each pressure chamber 112 includes a separate piezoelectric element 108 in this embodiment, but instead may be assigned, where one piezoelectric element 108 may be divided into a plurality of piezoelectric blocks by multiple grooves, each piezoelectric block.

The piezoelectric element 108 does not deform when no drive signal is transmitted to the external electrode and thus the electrical potential of the internal electrode is zero. When a drive signal is supplied to the external electrode, each piezoelectric element 108 is deformable in the direction D in FIG. 4 independently of other piezoelectric elements 108. In other words, the direction D is a polarization direction for the piezoelectric element. When the transmission of a drive signal is halted from the drive circuit 200 to the external electrode, i.e., by discharging the electric charge accumulated in the piezoelectric element 108, the piezoelectric element restores its original state.

Next, a description will be given of the manufacturing method of the inkjet head 100 according to the present invention, with reference to FIGS. 7 to 10.

A patterning process using a dry film resist in this embodiment forms three layers separately, heats them at about 150 degrees, joins them together, and cures them (steps 1100 to 1400). FIG. 7 shows only two adjacent pressure chambers for illustration purposes. Each of the steps 1100 to 1300 may be accomplished prior or parallel to other steps.

Figure 7:
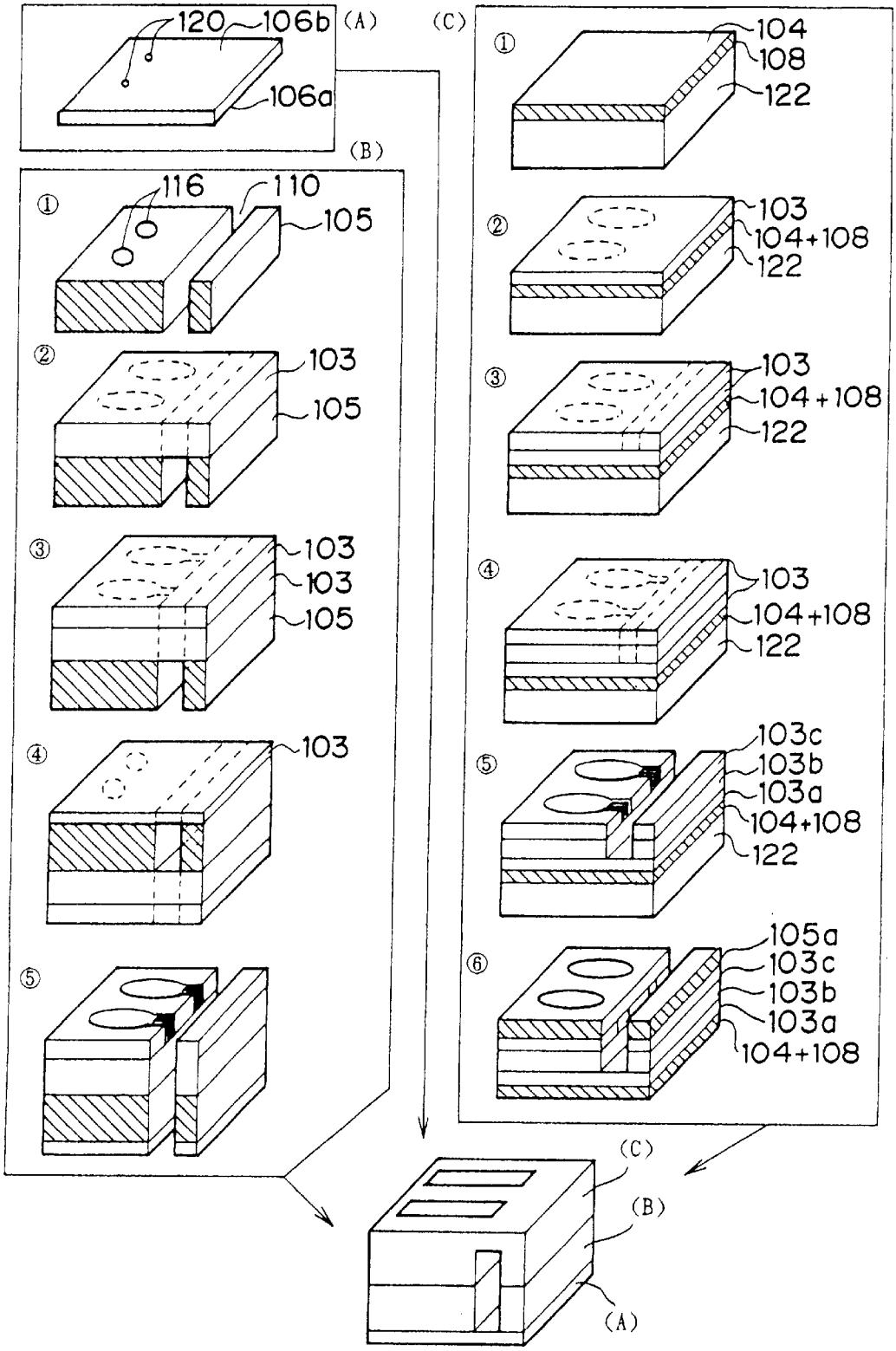
FIG. 7 is a perspective view showing a series of manufacturing steps for an inkjet head of a first embodiment of the invention.
Figure 8:
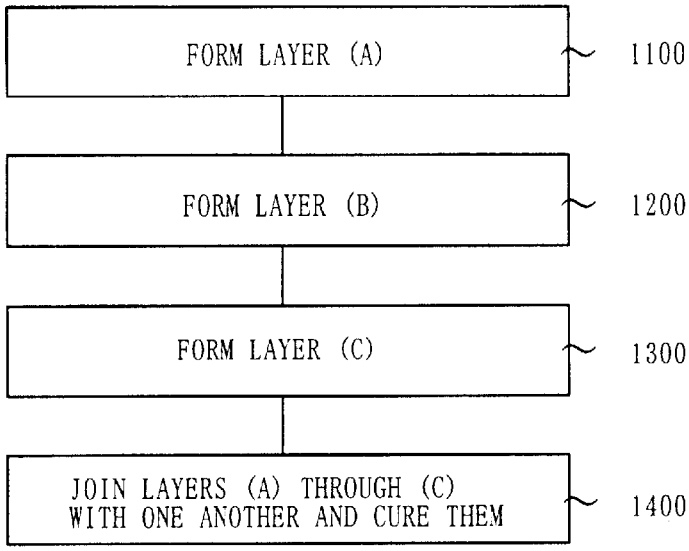
FIG. 8 is a flowchart for explaining the manufacturing steps in FIG. 7.
Figure 9:
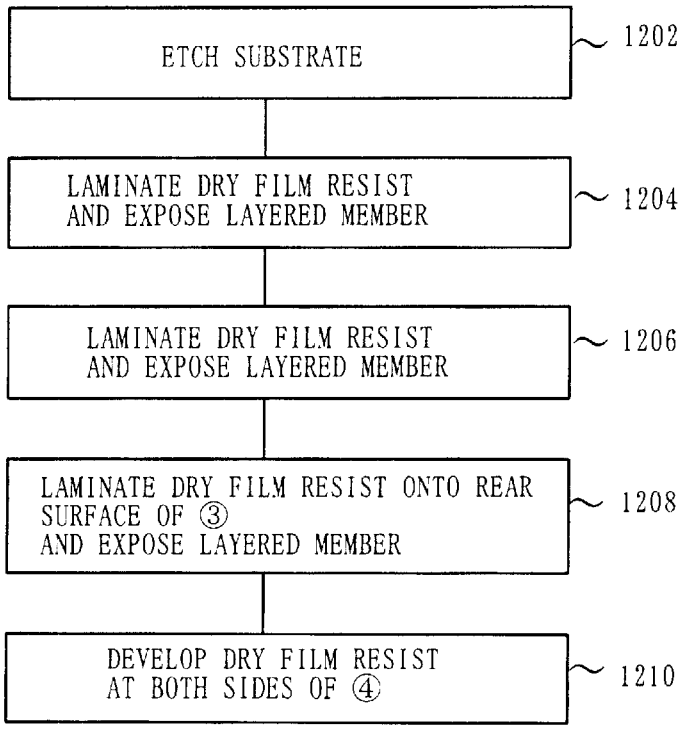
FIG. 9 is a flowchart for explaining part of the flowchart in FIG. 8 more concretely.
Figure 10:
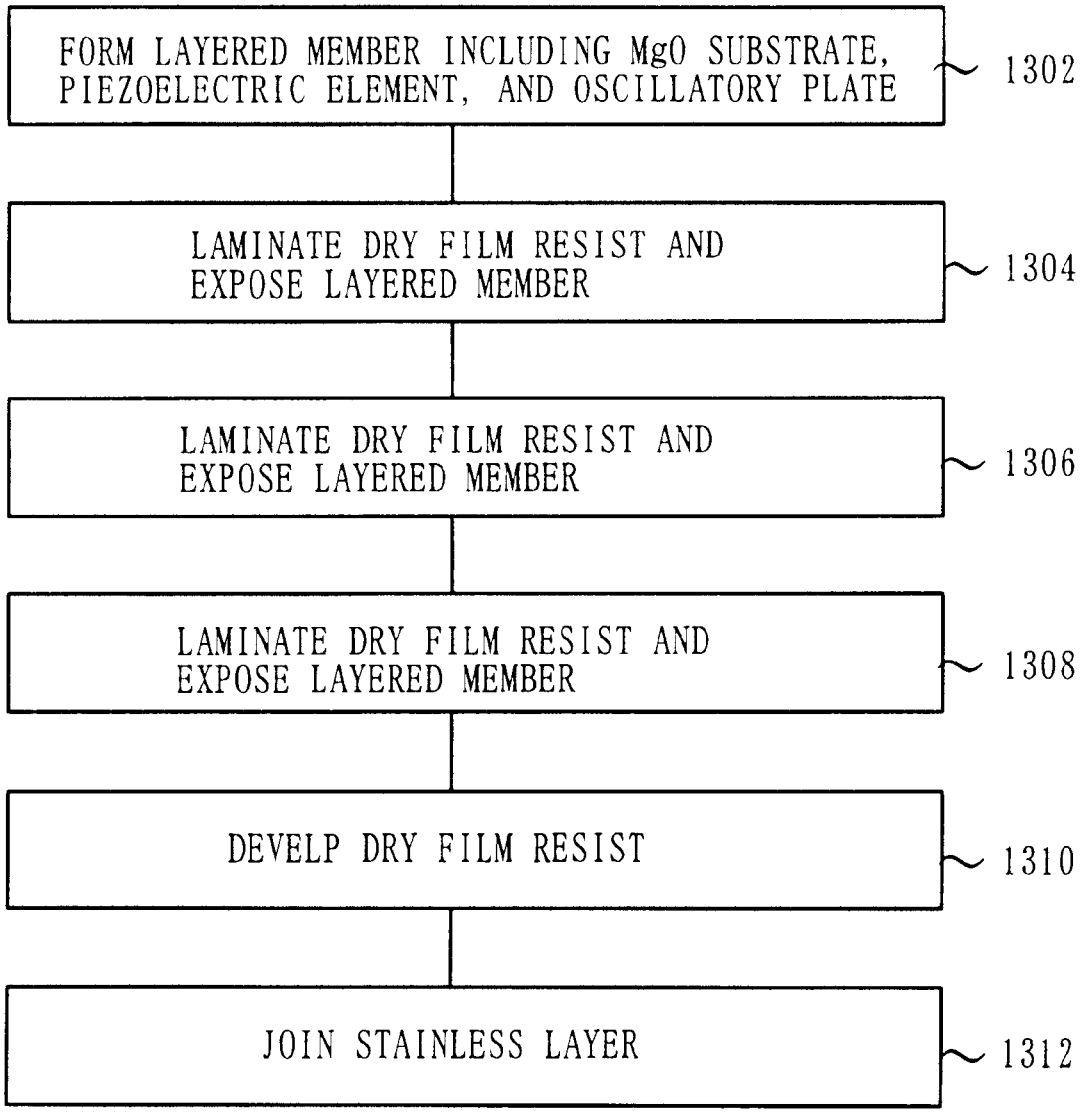
FIG. 10 is another flowchart for explaining part of the flowchart in FIG. 8 more concretely.

More specifically, the nozzle plate 106 (layer (A)) including nozzles 120 is made, as shown in FIGS. 7 (A) and 8, from stainless metal (step 1100). Each nozzle 120 is preferably processed into a cone shape (or taper shape in section) by a punch using a pin (not shown), which extends from front surface 106*a* on the nozzle plate 106 to its back surface 106*b* (which is joined to the pressure-chamber plate 102). One of the reasons for joining the nozzle plate 106 to the pressure-chamber plate 102 rather than integrating the pressure-chamber plate 102 with the nozzle plate 106 is to obtain such a cone nozzle 120.

Next, layer (B) is formed, as shown in FIG. 7(B), by laminating a dry film resist onto the stainless plate 105 (step 1200). More in detail, the step 1200 includes steps shown in FIG. 9. First, as shown in FIG. 7(B)①, the introduction path 116 and common ink chamber 110 are formed by etching the rigid stainless plate 105 (step 1202). Apparatuses necessary for etching are known to those skilled in this art, and a detailed description and illustration thereof will be omitted. In this embodiment, the nozzle plate 106 forms the layer (A) while the stainless plate 105 the layer (B). If both plates are formed on the same layer, etching of the stainless plate 105 would disadvantageously result in also etching of the nozzle plate 106. Thus, the above structure prevents such a disadvantage. However, it is noted that this embodiment does not argue that the inkjet head 100 of the present invention should be manufactured by joining these three layers, and those skilled in this art would understand that it is manufactured by an arbitrary number of layers. For example, joining two layers would make the inkjet head, as in inkjet head 100B that will be described later with reference to FIG. 17.

Then, as shown in FIG. 7(B)②, the dry film resist 103 (which corresponds to the dry film resist 103*e* in FIG. 3) is laminated as a first layer onto the stainless plate 105 so that those parts corresponding to the pressure chamber 112 and common ink chamber 110 may be exposed by a masking process (step 1204). Apparatuses necessary to laminate and expose a dry film resist are apparent to those skilled in the art, and a detailed description and illustration thereof will be omitted herewith. Desirably, a dry film resist, when used, is laminated on a rigid member (such as the stainless plate 105, nozzle plate 106, MgO substrate 122, etc.) as a substrate, and then joined together. It is needless to say that a rigid member is not limited to the stainless plate or MgO substrate.

As shown in FIG. 7(B)③, a dry film resist 103 is then laminated as a second layer (which corresponds to the dry film resist 103*d* in FIG. 3) onto the dry film resist 103 as the first layer so that those parts corresponding to the pressure chamber 112, the ink supply channel 114 and the common ink chamber 110 may be exposed by a masking process (step 1206).

As shown in FIG. 7(B)④, a dry film resist 103 as an adhesive layer onto the rear surface of the stainless plate 105 so that those parts corresponding to the introduction path 116 and the common ink chamber 110 may be exposed by a masking process (step 1206). This adhesive layer corresponds to the dry film resist 103*f* in FIG. 3.

The development at both sides would complete the layer (B) as shown in FIG. 7(B)⑤(step 1208).

As shown in FIG. 7 (C), layer (C) is formed by laminating a bimorph layered member and a dry film resist (step 1300). The layer (C) includes as much as three dry film resist layers. To give the details, the step 1300 is composed of steps shown in FIG. 10. First, as shown in FIG. 7(C)①, create a layered member for the MgO substrate 122, piezoelectric element 108 and oscillatory plate 104 (step 1302). The MgO substrate 122 serves to assist in stably creating the dry film resist layers 103*a* to 103*d* which will be described later as well as stably creating bimorph layered members 104 and 108.

More specifically, separate electrode 109 (signal electrode) is formed, as shown in FIG. 2, onto the MgO substrate 122. The piezoelectric elements 108 as a single layer are then grown by using sputtering in a lattice direction on the MgO substrate 122 throughout one surface of the MgO substrate 122. A chromium membrane is grown by using sputtering with an electric tube throughout one surface of the piezoelectric element 108. FIG. 7(C) illustrates the bimorph layered member as one layer composed of the piezoelectric element 108 and oscillatory plate 104.

In an attempt to use a layered piezoelectric element 108, the piezoelectric element 108 is formed by, for example, mixing each of multiple green sheets with a solvent such as ceramic powder, kneading them into a paste, and forming a thin film of an about 50 $\mu$m thickness using a doctor blade. A strong dielectric substance may be used such as Ba, $TiO_3$, $PbTiO_3$, $(NaK)NbO_2$ as generally-used materials for a piezoelectric element.

Among these green sheets, a first internal electrode pattern is formed and printed on one surface of each of three green sheets, while a second internal electrode pattern is formed and printed on one surface of each of other three green sheets. Nothing is printed on the remaining sheets. The first and second internal electrodes are printed and patterned by mixing powder of metal alloy of silver and palladium with a solvent into a paste, and applying the paste to the sheets.

The three sheets printed with the first electrode are alternately adhered to the three sheets printed with the second electrode, and then adhered to the remaining six sheets, whereby the layered piezoelectric element 108 is formed. Those lower green sheets that do not include any internal electrode become a fundamental part in the piezoelectric element 108. These green sheets are sintered in a layered state.

As shown in FIG. 7(C)②, a dry film resist 103 is laminated as a first layer (which corresponds to the dry film resist 103*a* in FIG. 3) onto the oscillatory plate 104, whereby part corresponding to the pressure chamber 112 is exposed by the masking process (step 1304).

As shown in FIG. 7(C)③, a dry film resist 103 is laminated as a second layer (which corresponds to the dry film resist 103*b* in FIG. 3) onto the dry film resist laminate 103*a* as the first layer, whereby part corresponding to the pressure chamber 112 and common ink common 110 is exposed by the masking process (step 1306).

As shown in FIG. 7(C)④, a dry film resist 103 is then laminated as a third layer (which corresponds to the dry film resist 103*c* in FIG. 3) onto the dry film resist laminate 103*b* as the second layer, whereby part corresponding to the pressure chamber 112, ink supply channel 114 and common ink chamber 110 is exposed by the masking process (step 1308).

As shown in FIG. 7(C)⑤, the above layers are developed (step 1310), whereby the layered members which laminate the piezoelectric element 108 to the dry film resist 103*c* in FIG. 3 onto the MgO substrate 122 are created.

Then, the stainless layer 105*a* whose part corresponding to the pressure chamber 112 has been removed beforehand by etching is characteristically joined, as shown FIG. 7(C)⑥, onto the dry film resist layer 103*c* (step 1312). And the MgO substrate 122 is removed. In this embodiment, the number of joint areas among the layers (A) through (C) is two (one between the layers (A) and (B), and one between the layers (B) and (C)), as shown in FIG. 7. Thus, only two stainless layers 105 (namely, 105*a* and 105*b*) are provided. These layers (A) through (C) will be joined and cured later (step 1400).

The stainless layer 105*a* serves to prevent the dry film resist layer 103*c* etc. to flow into the dry film resist layer 103*d* when the layer (C) is joined to the layer (B). The conventional photo-lithography manufacturing method using a dry film resist, has used no member corresponding to the stainless layer 105*a,* and been disadvantageous in that the dry film resist layer 103*c,* for example, readily flows into the ink supply channels 114*c* and 114*d* on the dry film resist layer 103*d,* deteriorating a patterning size precision.

This embodiment provides the stainless layer 105*a* (or an alternative rigid member such as metal or ceramic) between two dry film resist layers 103*c* and 103*d* to be joined, and advantageously forms multi-layer ink supply channels 114 with high precision. In other words, each ink supply channel 114 that remains stable before and after the joining process would provide high processing precision and facilitate a miniature inkjet head. Although the stainless layer 105*a* is joined onto the dry film resist layer 103*c* in this embodiment, the stainless layer 105*a* may be joined onto the dry film resist layer 103*d* in the layer (B) instead of or in addition to this.

In addition, this embodiment sets the (B) layer to be three layers (excluding the adhesive layer) and the layer (C) to be five layers in FIG. 7(C)⑤, then laminating the stainless layer 105*a* on these layers. Nevertheless, the number of laminated layers of layers (B) and (C) may be changed to a desired number, and the thickness of each layer may be adjusted desirably. In other words, the stainless layer 105*a* may be located between the adjacent dry film resist layers at an arbitrary joint surface among the dry film resist layers 103*a* to 103*e*.

The stainless layer 105*a* thus serves as a shielding member that shields both opposite ink supply channels (such as 114*a* and 114*c,* 114*b* and 114*d*), and may use, in addition to metal or ceramic, a member made of resin (e.g., PEN) or composite resin (e.g., FRP). In particular, such a member has a thermal expansion coefficient similar to that of other dry film resist layers 103, and it has an effect of reducing a thermal residual stress during a heat treatment, such as at the time of joining. The head components are so thermally homogeneous that each component exhibits little thermal expansion offset after undergoing the heat treatments at the time of adhering and joining in the head manufacturing process. Consequently, such a resin is effective in reducing the thermal residual stress.

Figure 11:
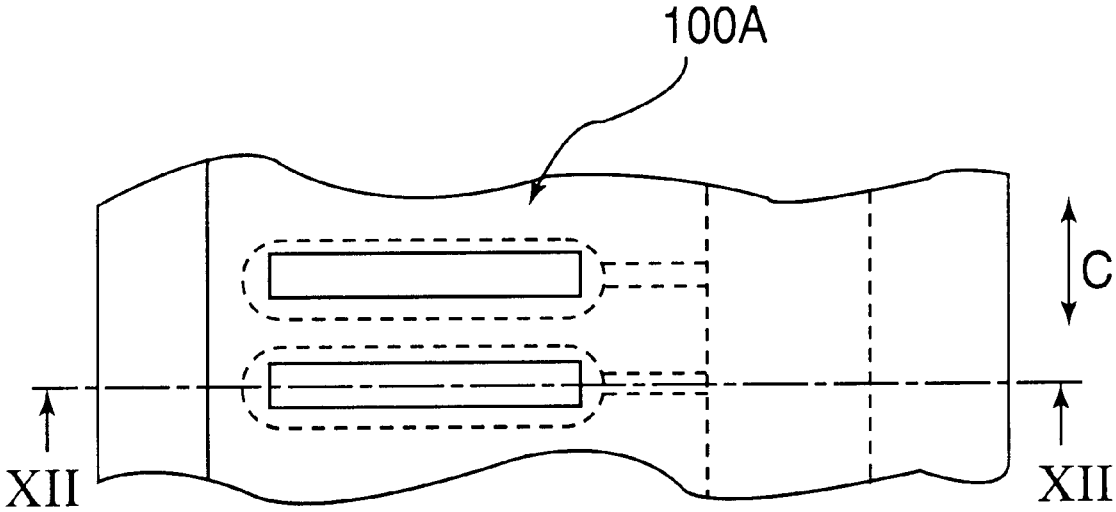
FIG. 11 is a partial plan view of an inkjet head of a third embodiment of the present invention.
Figure 12:
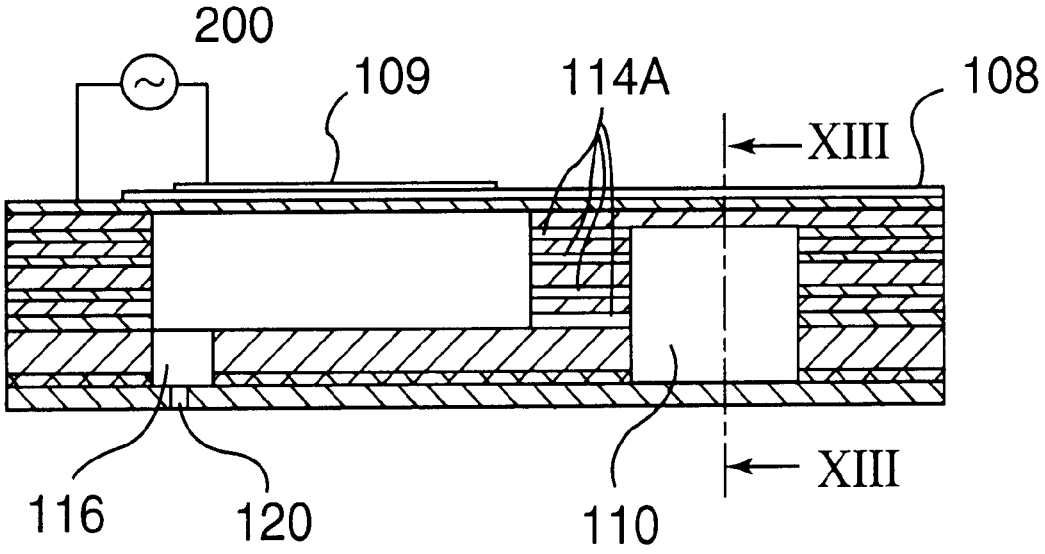
FIG. 12 is a cross section taken along line A–A' in FIG. 11.
Figure 13:
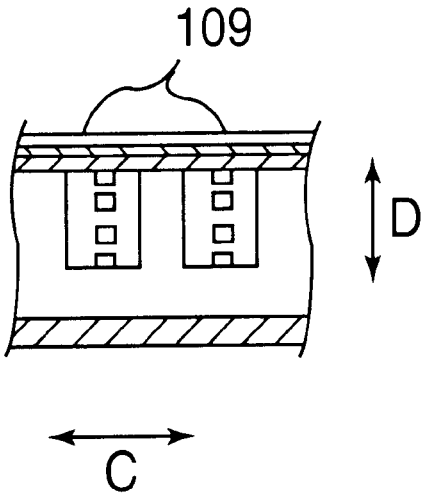
FIG. 13 is a cross section taken along line B–B' in FIG. 12.

FIGS. 11 to 13 show inkjet head 100A that is an exemplified variation of the present invention. As best shown in FIG. 13, four ink supply channels 114A align with the direction D one by one. It is understood that the inkjet head 100A has only one ink supply channel 114A in the direction C, and would realize the higher resolution than the inkjet head 100. These four ink supply channels 114A shown in FIG. 13 need not align with a straight line, as is the case with FIG. 5.

Figure 14:
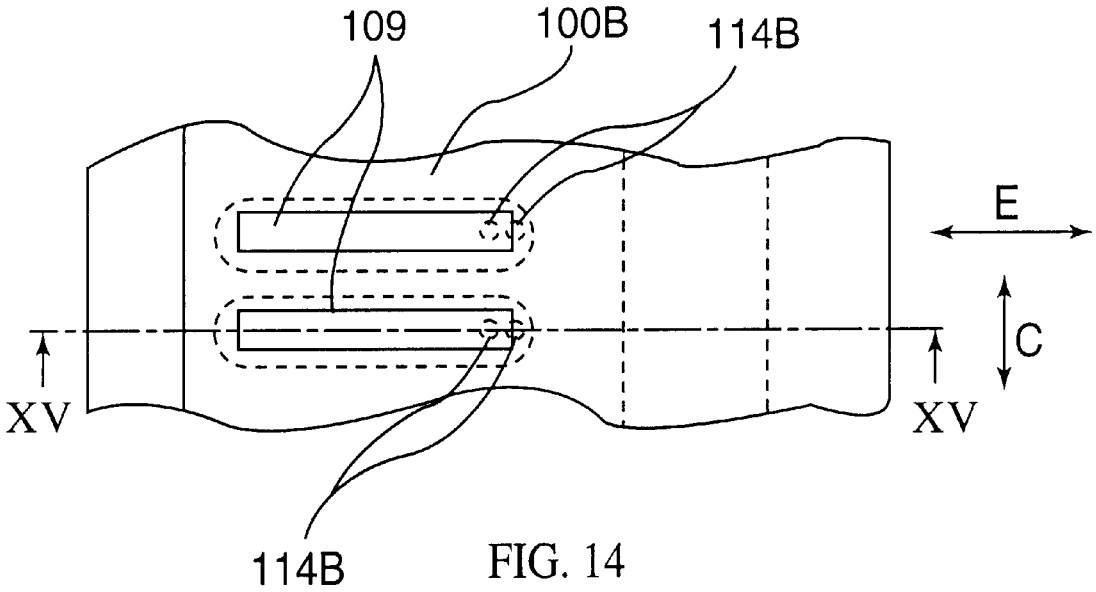
FIG. 14 is a partial plan view of an inkjet head of the third embodiment according to the present invention.
Figure 15:
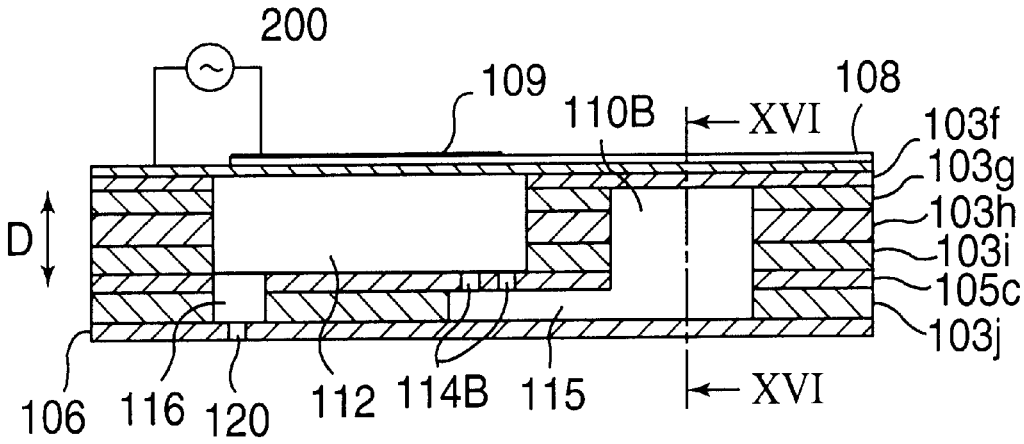
FIG. 15 is a cross section taken along line A–A in FIG. 14.
Figure 16:
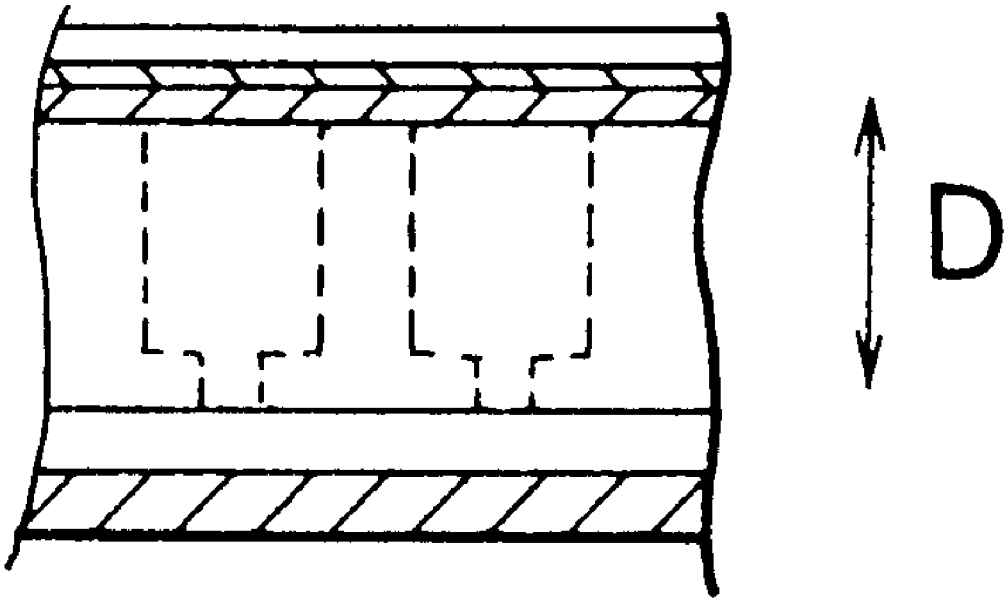
FIG. 16 is a cross section taken along line B–B' in FIG. 15.

FIGS. 14 to 16 show inkjet head 100B that is another exemplified variation of the present invention. As best shown in FIG. 15, the common ink chamber 110B has a shape of the common ink chamber 110 shown in FIG. 3 plus sidelong groove 115 extending towards the pressure chamber 112 in the inkjet head 100B.

Two ink supply channels 114B are arranged parallel to the direction D in the longitudinal direction of the pressure chamber (that is, direction E). The inkjet head 100B has only one ink supply channel 114B in the direction in which the pressure chambers 112 are arranged (i.e., the direction C), and may realize the higher resolution than the inkjet head 100. These two ink supply channels 114B shown in FIG. 15 need not align with a straight line, as is the case with FIG. 5. FIG. 15 simplifies the size of each ink supply channel 114B for illustration purposes, and emphasizes only its location.

With reference to FIGS. 17 through 20, a description will now be given of the manufacturing method of the inkjet head 100B of the present invention.

Figure 17:
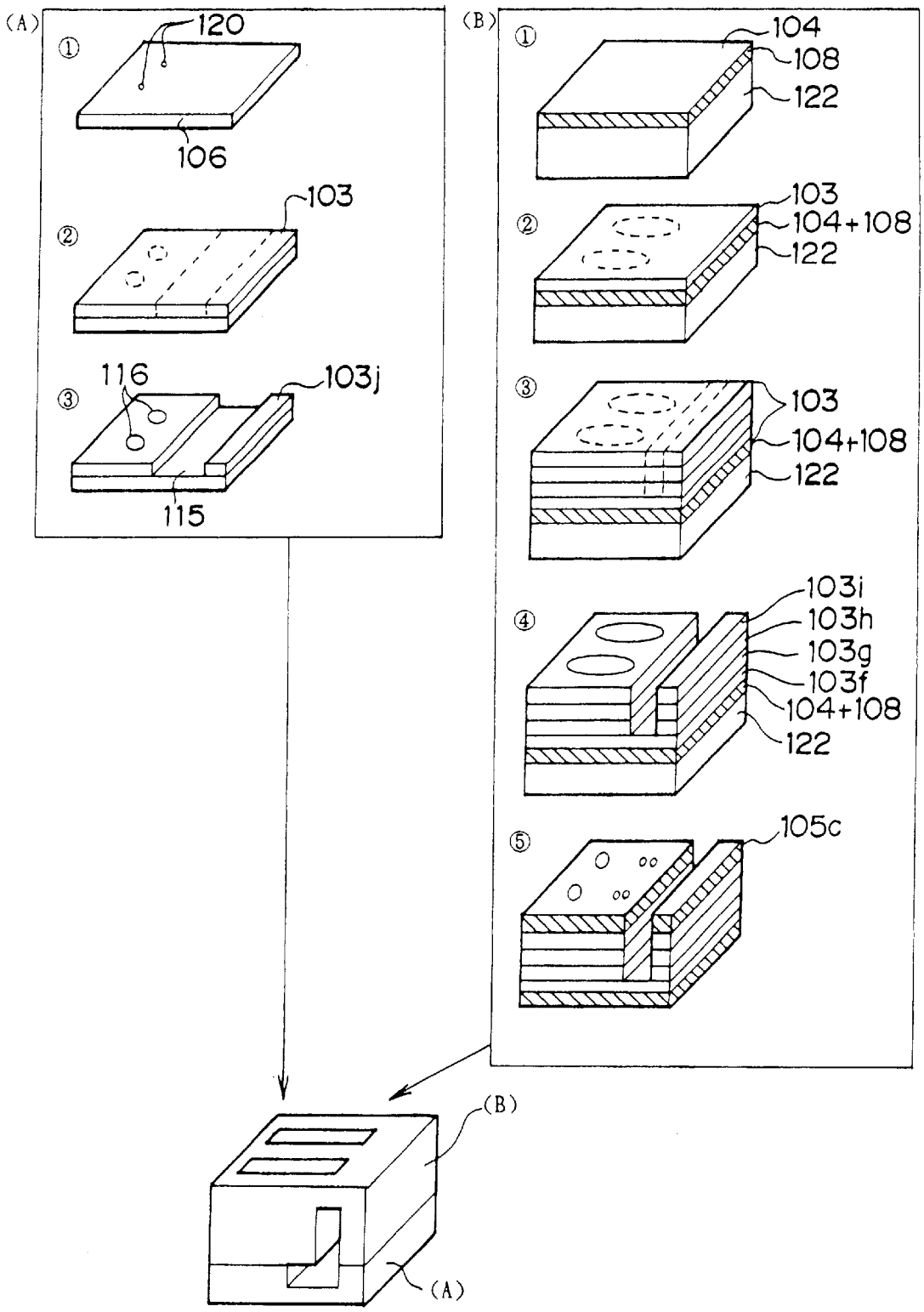
FIG. 17 is a perspective view showing a series of manufacturing steps for an inkjet head of a third embodiment according to the present invention.

A patterning process using a dry film resist in this embodiment forms two layers separately, heats them at about 150 degrees, joins them together, and cures them (steps 2100 to 2300). FIG. 17 shows only two adjacent pressure chambers for illustration purposes. Either steps 2100 or 2300 may be accomplished prior or parallel to the other steps.

Figure 18:
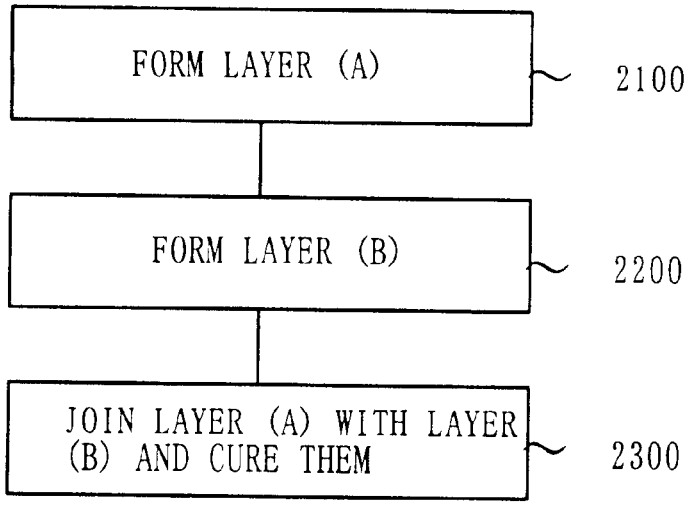
FIG. 18 is a flowchart for explaining the manufacturing steps in FIG. 17.
Figure 19:
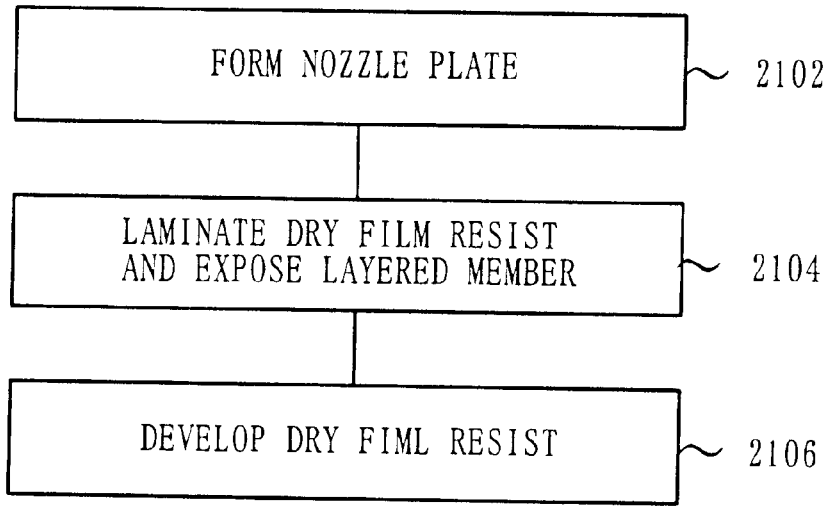
FIG. 19 is a flowchart for explaining part of the flowchart in FIG. 18 more concretely.
Figure 20:
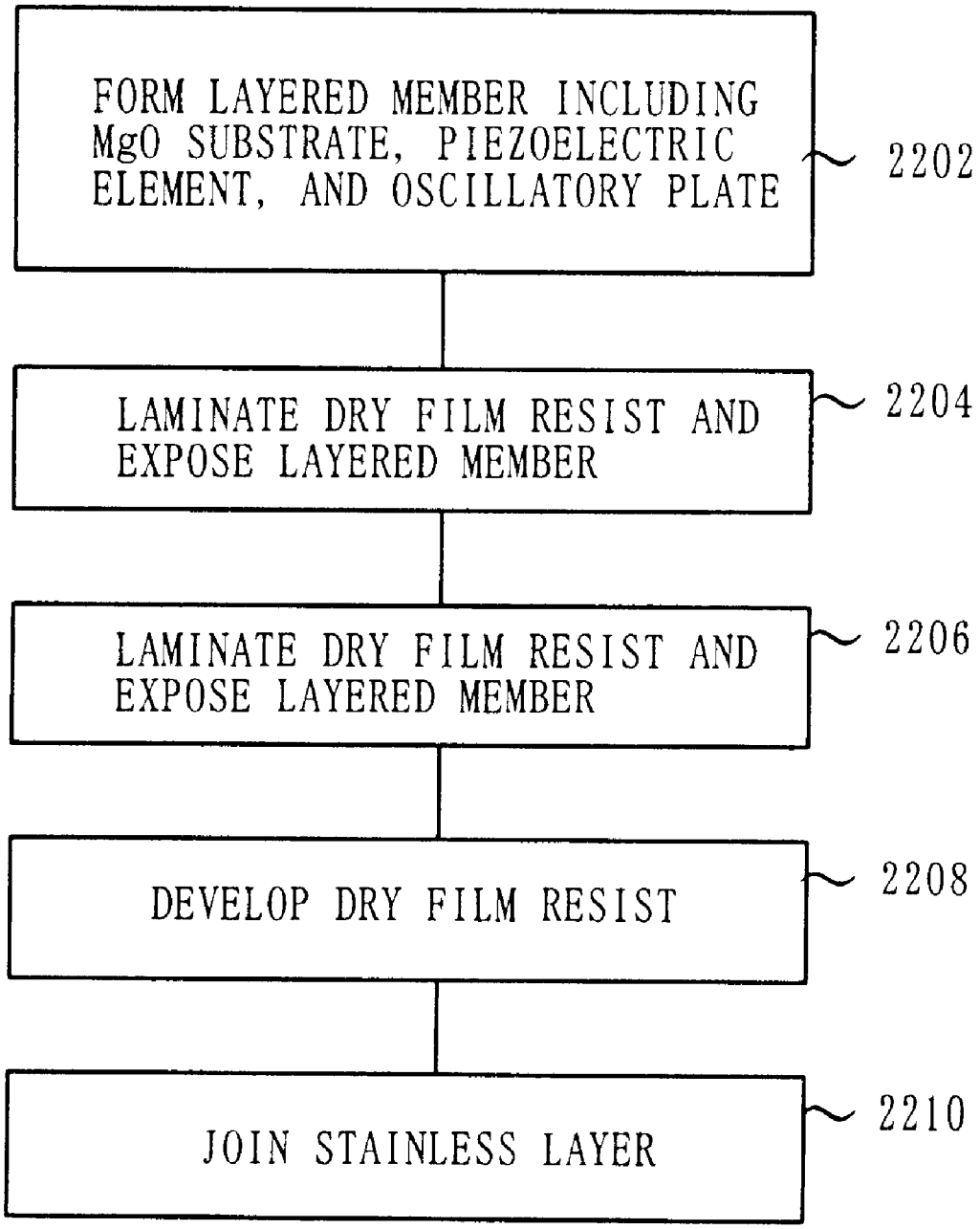
FIG. 20 is another flowchart for explaining part of the flowchart in FIG. 18 more concretely.

More specifically, layer (A) is formed by laminating a dry film resist onto the nozzle plate 106 including the nozzles 120, as shown in FIGS. 17(A) and 18 (step 2100). More specifically, the step 2100 includes the steps shown in FIG.

19. At first, as shown in FIG. 17(A)①, the nozzle plate is formed in the same way as the step 1100 in FIG. 8 (step 2102).

Next, as shown in FIG. 17 (A)②, a dry film resist 103 (which corresponds to the dry film resist 103*j* in FIG. 15) is laminated onto the nozzle plate 106, whereby part corresponding to the introduction path 116, a fundamental part of the common ink chamber 110B, and the sidelong groove 115 is exposed by the masking process (step 2104).

Then, as shown in FIG. 17(A)③, the dry film resist 103 is developed, whereby the layer (A) is completed as shown in FIG. 17(A)③(step 2106). Thus, this embodiment laminates the dry film resist 103 onto the nozzle plate 106.

On the other hand, as shown in FIG. 17(B), the layer (B) is formed by laminating a bimorph layered member and dry film resists (step 2200). The layer (B) includes as much as four dry film resist layers. More specifically, step 2200 includes the steps shown in FIG. 20. First, as shown in FIG. 17(B)①, a layered member is formed including the MgO substrate 122, piezoelectric element 108 and oscillatory plate 104 in the same way as the steps shown in FIG. 20 (step 2202). FIG. 17B shows as one layer a bimorph layered member including the piezoelectric element 108 and the oscillatory plate 104.

Next, as shown in FIG. 17(B)②, a dry film resist 103 is laminated as a first layer (which corresponds to the dry film resist 103*f* in FIG. 15) onto the oscillatory plate 104, and part corresponding to the pressure chamber 112 is exposed by the masking process (step 2204).

Subsequently, as shown in FIG. 17(B)③, dry film resists 103 are laminated as second to fourth layers (which correspond to the dry film resists 103*g* to 103*i* in FIG. 15) onto the dry film resist laminate 103 as the first layer, and part corresponding to the pressure chamber 112 and common ink common 110 is exposed by the masking process (step 2206).

The member is developed as shown in FIG. 17(B)④(step 2208), and the layered member which laminates the piezoelectric element 108 through the dry film resist 103*i* in FIG. 15 onto the MgO substrate 122 is formed.

Characteristically, the stainless layer 105*c* in which part corresponding to the introduction path 116 and ink supply channel 114B has been removed beforehand by etching is then joined, as shown FIG. 17(B)⑤, onto the dry film resist layer 103*i* (step 2210). The MgO substrate 122 is then removed. There is only one joint surface between the layers (A) and (B) in this embodiment as shown in FIG. 17, and thus only one stainless layer 105 is located. However, if the manufacturing process needs increase rigidity, any number of stainless layers may be added. These layers (A) and (B) will be joined later and cured (step 2300).

The reason why the stainless layer 105*c* is located on the dry film resist layer 103*i* is that the layer including ink supply channels 114B overhangs on the sidelong groove 115 from the position where the ink supply channels 114B are provided, and thus, if this part does not have rigidity of a certain degree, it would infiltrate into the sidelong groove 115.

The present invention may arbitrarily combine the foregoing arrangements of the ink supply channels 114. For example, two out of four ink supply channels could be arranged in the direction D as shown in FIG. 13, whereas the remaining two in the direction E as shown FIGS. 15 and 16.

The inkjet head 100 of the present invention layers in the direction D and experiences the exposure and development, etc., and the ink supply channels 114 are formed parallel or perpendicular to the direction D. Nevertheless, it is apparently understood that those ink supply channels 114 inclined at a predetermined angle with respect to the direction D fall within the scope of the present invention. The ink supply channel 114 may take an arbitrary sectional shape in addition to the rectangular shape. Its cross-sectional area needs not be fixed, e.g., and it may have a gradually expanding cross-section. It is apparently understood that the ink supply channel 114 can be applied for connection with the piezoelectric element 112 and the common ink chamber 110 that have an arbitrary shape in addition to a cuboid shape.

Further, the present invention is not limited to these preferred embodiment, but various variations and modifications may be made without departing from the scope of the present invention.

As described, according to the inventive inkjet head and the inventive inkjet printer having the inkjet head, all the ink supply channels do align with a direction in which the piezoelectric elements are arranged. Thereby, the head is miniaturized by reducing a nozzle pitch in the direction in which the piezoelectric elements are arranged. The inkjet head of the present invention becomes smaller than the conventional one, exhibiting higher degree of integration and resolution.

Increasing of the number of ink supply channels using the equivalence of ink hydraulic resistance provides a wall defining the ink supply channel with a desired length, desired strength and adhesiveness.

Further, the present invention may provide a rigid member made of such metal or ceramic as has a high Young's modulus between adjacent layers which form the ink supply channels, so as to stably maintain the opposite ink supply channels, when these layers are joined to be an inkjet head. Such a member particularly enables a plurality of layers of ink supply channels to be manufactured with high precision in the manufacturing method of an inkjet head using a dry film resist. A resin or composite resin member, if provided in place of metal, has a thermal expansion coefficient close to that of a dry film resist and thus would reduce a thermal expansion offset result in each layer even when the manufacturing process includes a heat treatment. As a result, a member made of resin etc. would bring about an effect of reducing a thermal residual stress.

What is claimed is:

1. An inkjet head comprising:

a pressure chamber plate containing a plurality of substantially separated pressure chambers, a common ink chamber spaced from the pressure chambers and a plurality of ink supply channels arranged in groups that each supply a pressure chamber with ink from the common ink chamber, each group of ink supply channels including a plurality of substantially parallel passages that each extend between and communicate at opposite ends between the common ink chamber and an associated pressure chamber, a piezoelectric element operative to selectively pressurize a pressure chamber in said pressure-chamber plate; and a nozzle plate that includes a nozzle which jets ink from the pressure chamber when said piezoelectric element pressurizes said pressure chamber, wherein said ink supply channels are connected in plural number to each pressure chamber, and arranged in a direction perpendicular to a direction in which said plurality of pressure chambers are arranged.

2. An inkjet head according to claim 1, wherein part of said ink supply channels are arranged in a direction parallel to the direction in which said plural pressure chambers are arranged, while the rest of said ink supply channels are arranged in the direction perpendicular to that in which the pressure chambers are arranged.

3. An inkjet head according to claim 1, wherein the number of said ink supply channels that are connected to each pressure chamber is nearly equal to a quotient produced by dividing an interval between the adjacent pressure chambers by a length necessary for said ink supply channels to achieve predetermined ink hydraulic resistance, each of which channels has a predetermined sectional shape.

4. An inkjet head according to claim 1, further comprising between two adjacent ink supply channels connected to each pressure chamber, a layer having a Young's modulus higher than that of each of two layers which define said two ink supply channels.

5. An inkjet head comprising:

a pressure chamber plate containing a plurality of substantially separated pressure chambers, a common ink chamber spaced from the pressure chambers and a plurality of ink supply channels arranged in groups that each supply a pressure chamber with ink from the common ink chamber, each group of ink supply channels including a plurality of substantially parallel passages that each extend between and communicate at opposite ends between the common ink chamber and an associated pressure chamber, a piezoelectric element operative to selectively pressurize the pressure chambers in said pressure-chamber plate; and a nozzle plate that includes a nozzle which jets ink from said pressure chamber when said piezoelectric element pressurizes said pressure chamber, wherein said ink supply channels are connected in plural number to each pressure chamber, and arranged two-dimensionally at random with respect to a plate parallel to a direction in which said plurality of pressure chambers are arranged.

6. A printer comprising an inkjet head, and a drive unit which drives said inkjet head, wherein said inkjet head comprises:

a pressure chamber plate containing a plurality of substantially separated pressure chambers, a common ink chamber spaced from the pressure chambers and a plurality of ink supply channels arranged in groups that each supply a pressure chamber with ink from the common ink chamber, each group of ink supply channels including a plurality of substantially parallel passages that each extend between and communicate at opposite ends between the common ink chamber and an associated pressure chamber, a piezoelectric element operative to selectively pressurize a pressure-chamber plate; and a nozzle plate that includes a nozzle which jets ink from the pressure chamber when said piezoelectric element pressurizes said pressure chamber, wherein said ink supply channels are connected as a group to each pressure chamber, and arranged in a direction perpendicular to that in which said plural pressure chambers are arranged.

* * * * *